US005207416A

United States Patent [19]

Soler

[11] Patent Number: 5,207,416

[45] Date of Patent: May 4, 1993

[54] STACK HEIGHT SENSING SYSTEM

[75] Inventor: Jose J. Soler, Fairport, N.Y.

[73] Assignee: Xerox Corporation, Stamford, Conn.

[21] Appl. No.: 858,459

[22] Filed: Mar. 27, 1992

[51] Int. Cl.[5] ..... B65H 7/02

[52] U.S. Cl. ..... 271/31; 271/260; 271/265; 73/37.5

[58] Field of Search ..... 271/25, 31, 130, 152, 271/154, 155, 260, 265; 73/37.5, 37.6; 33/DIG. 2

[56] References Cited

U.S. PATENT DOCUMENTS

| | | | |
|---|---|---|---|
| 2,902,278 | 9/1959 | Bradshaw | 271/154 X |
| 3,123,355 | 3/1964 | Lessig | 271/154 |
| 3,734,313 | 5/1973 | Gauthier et al. | 73/37.5 X |
| 3,768,806 | 10/1973 | Reehil | 271/155 |
| 4,801,135 | 1/1989 | Povio | 271/155 |

*Primary Examiner*—H. Grant Skaggs

*Assistant Examiner*—Carol Lynn Druzbick

*Attorney, Agent, or Firm*—H. Fleischer; J. E. Beck; R. Zibelli

[57] ABSTRACT

An apparatus in which a stack of sheets is detected at a preselected location. An air jet is directed towards an edge of the stack of sheets at a preselected location. A pressure transducer is located at the prescribed location and positioned to have the air jet at impact thereon. The pressure transducer is enabled to transmit a signal indicative of the absence of the stack of sheets at the preselected location in response to the air jet impacting thereon. The pressure transducer is inhibited from transmitting the signal in response to the stack of sheets blocking the air jet. When the stack of sheets blocks the air jet, the signal from the pressure transducer indicates the presence of the stack of sheets at the preselected location. A pneumatic stack height detector of this type may be used to regulate the movement of a stack of sheets used in electrophotographic printing machines.

4 Claims, 3 Drawing Sheets

STACK HEIGHT SENSING SYSTEM

This invention relates generally to an electrophotographic printing machine, and more particularly concerns an apparatus for detecting a stack of sheets at preselected location.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive surface selectively dissipates the charge thereon in the irradiated areas. This records an electrostatic latent image on the photoconductive member corresponding to the informational areas contained within the original document. After the electrostatic latent image is recorded on the photoconductive surface, a latent image is developed by bringing a developer material into contact therewith. Generally, the developer material comprises toner particles adhering triboelectrically to carrier granules. Toner particles are attracted from the carrier granules to the latent image forming a toner powder image on the photoconductive surface. The toner powder image is then transferred from the photoconductive surface to a copy sheet. Toner particles on the copy sheet are heated to permanently affix the powder image to the copy sheet.

In a high speed commercial printing machine of the foregoing type, large volumes of copy sheets are fed from an elevator type of sheet feeding tray. The tray is mounted on a frame and moves vertically from a sheet feeding position to a sheet loading and unloading position. At the lowermost position, copy sheets are loaded or unloaded from the tray. After the copy sheets are loaded in the tray, the tray ascends to its uppermost position for sheet feeding. A sensor is located in the uppermost region to indicate when the stack of sheets is positioned appropriately for sheet feeding. Moreover, as successive sheets are advanced from the stack on the elevator, the elevator is continuously moved in an upward direction to position the next successive uppermost sheet adjacent the sheet feeder. The stack height sensor detects the location of the uppermost portion of the stack and insures that the uppermost sheet thereof is properly located relative to the sheet feeder. In this way, successive sheets are fed from the stack and the elevator is continuously moved upward to locate the next adjacent uppermost sheet in the proper sheet feeding position. This is achieved by a control system wherein the output signal from the stack height sensor is transmitted through control logic to a motor which drives the tray bidirectionally. In this way, movement of the elevator having the stack of sheets thereon is controlled as a function of the location of the uppermost sheet of the stack. Hereinbefore, the stack height sensor has generally been an optical sensor. Alternatively, contact sensors have also been used. However, it has been found that optical sensors frequently get dirty in the printing machine environment and their performance degrades. Similarly, because of timing, speed or function problems, a contact type of sensor may not always be employed.

Various approaches have been devised for detecting the location of the stack of sheets loaded on an elevator and being positioned adjacent a sheet feeder for advancement to the processing stations within the printing machine. The following disclosures appear to be relevant:

U.S. Pat. No. 3,768,806
Patentee: Reehil
Issued: Oct. 30, 1973

U.S. Pat. No. 4,801,135
Patentee: Povio
Issued: Jan. 31, 1989

The relevant portions of the foregoing patents may be briefly summarized as follows:

U.S. Pat. No. 3,768,806 discloses a transducer provided to ascertain when the topmost sheet of a stack of sheets is in the proper position for feeding to the sheet transport mechanism and produces a signal representative thereof. The transducer has a spring-biased level arm coupled to a mechanical switch whereby the angular rotation of the lever arm is a function of the position of the topmost sheet stacked upon the elevator. Thus, if the topmost sheet is not in position to be fed to the sheet transport mechanism, the lever arm will rotate, under the influence of the bias spring, to a position effecting the closure of the switch. The single produced by the transducer is utilized by the control system to regulate the movement of the elevator.

U.S. Pat. No. 4,801,135 describes a stack height switch which is mounted on a movable rear guide and provides an indication of when the uppermost sheet of the stack is in the sheet feeding position. The switch controls a motor to maintain the uppermost sheet of the stack in a sheet feeding position adjacent the feed belt. Other sensors, i.e. photodetectors, are employed to determine the location of the stack at various other points.

In accordance with one aspect of the present invention, there is provided an apparatus for detecting a stack of sheets at a preselected location. The apparatus includes means for generating a flow of air. Means are provided for receiving the air flowing from the generating means. The receiving means is enabled to transmit a signal indicative of the absence of the stack of sheets at the preselected location in response to receiving the air flow. The receiving means is inhibited from transmitting the signal in response to the stack of sheets blocking the air flow to indicate the presence of the stack of sheets at the preselected location.

Pursuant to another aspect of the present invention, there is provided an apparatus for controlling a stack of sheets to position an outermost sheet adjacent a sheet feeder to advance successive outermost sheets from the stack. The apparatus includes means for supporting the stack of sheets. Means are provided for moving the supporting means. A pneumatic detector senses the absence or presence of the outermost sheet adjacent the sheet feeder and generates a signal indicative thereof. The moving means, in response to the signal from the pneumatic detector, moves the supporting means to position the outermost sheet of the stack adjacent the sheet feeder.

Still another aspect of the present invention is an electrophotographic printing machine of the type in which a latent image is developed on a photoconductive member and the developed image transferred to a copy sheet with successive copy sheets being supplied from a stack thereof. The improvement includes a sheet feeder and a tray arranged to have the stack of copy sheets disposed thereon. The tray is adapted to move between a first position with an outermost copy sheet of the stack being adjacent the sheet feeder and a second position remote therefrom. The sheet feeder is adapted to advance successive outermost copy sheets from the stack thereof with the tray being in the first position. Means are provided for moving the tray to control the position thereof. A pneumatic detector senses the absence and presence of the outermost sheet adjacent the sheet feeder and generates a signal indicative thereof. The moving means, in response to the signal from the pneumatic detector, moves the tray to position the outermost copy sheet of the stack adjacent the sheet feeder.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents, as may be included within the spirit and scope of the invention as defined by the appended claims.

Figure 3:
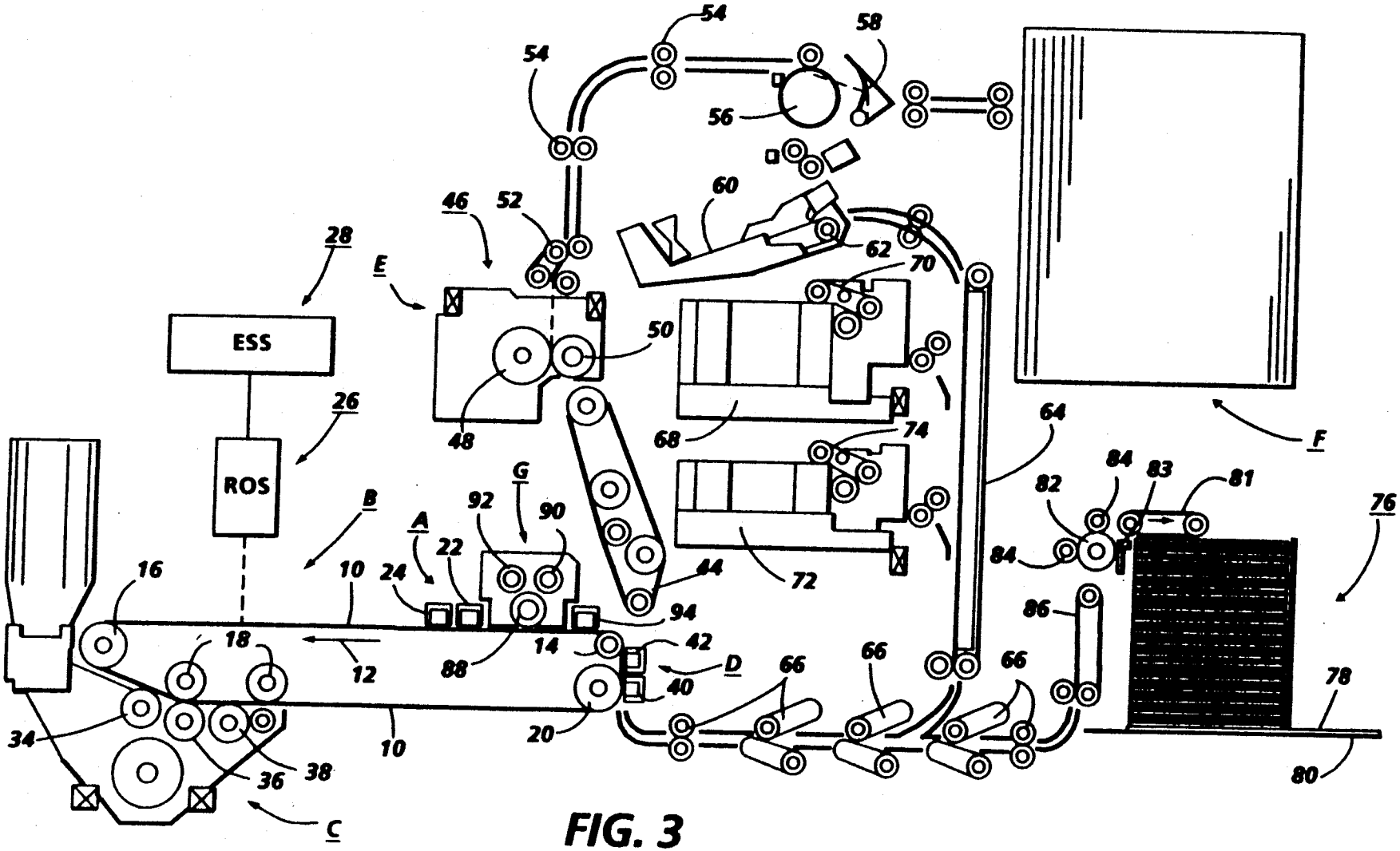
FIG. 3 is a schematic elevational view depicting an illustrative electrophotographic printing machine incorporating the sheet handling apparatus of the present invention therein.

For a general understanding of the features of the present invention, reference is made to the drawings. In the drawings, like reference numerals have been used throughout to identify identical elements. FIG. 3 schematically depicts an electrophotographic printing machine incorporating the features of the present invention therein. It will become evident from the following discussion that the stack height detector of the present invention may be employed in a wide variety of devices and its not specifically limited in its application to the particular embodiment depicted herein.

Referring initially to FIG. 3 of the drawings, the electrophotographic printing machine employs a photoconductive belt 10. Preferably, the photoconductive belt is made from a photoconductive material coated on a ground layer, which, in turn, is coated on any anti-curl backing layer. The photoconductive material is made from a transport layer coated on selenium generator layer. The transport layer transports positive charges from the generator layer. The generator layer is coated on an interface layer. The interface layer is coated on a ground layer made from a titanium coated Mylar. The interface layer aids in the transfer of electrons to the ground layer. The ground layer is very thin and allows light to pass therethrough. Other suitable photoconductive materials, ground layers and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roller 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge photoconductive belt 10 to a relatively high, substantially uniform potential. Corona generating device 22 places all the required charge on photoconductive belt 10. Corona generating device 24 acts as leveling device and fills in any areas missed by corona generating device 22. Next, the charged portion of the photoconductive surface is advanced through imaging station B.

At imaging station B, a raster output scanner (ROS), indicated generally by the reference numeral 26, discharges selectively those portions of the charge corresponding to the image portions of the document to be reproduced. In this way, an electrostatic latent image is recorded on the photoconductive surface. An electronic subsystem (ESS), indicated generally by the reference numeral 28, controls ROS 26. ESS 28 is adapted to receive signals from a computer and transpose these signals into suitable signals for controlling ROS 26 so as to record an electrostatic latent image corresponding to the document to be reproduced by the printing machine. ROS 26 may include a laser with a rotating polygon mirror block. The ROS illuminates the charged portion of the photoconductive surface at a rate of about 300 pixels per inch. In this way, a raster electrostatic latent image is recorded on the photoconductive surface which corresponds to the desired information to be printed on the sheet. After the raster electrostatic latent image is recorded on the photoconductive surface, the photoconductive belt 10 rotates the raster electrostatic latent image to development station C.

At development station C, three magnetic brush developer rolls indicated generally by the reference numerals 34, 36 and 38 develop the electrostatic latent image. A paddle wheel picks up developer material and delivers it to the developer rolls. When developer material reaches rolls 34 and 36, it is magnetically split between the rolls with half of the developer material being delivered to each roll. Photoconductive belt 10 is partially wrapped around rolls 34 and 36 to form an extended development zone. Developer roll 38 is a clean-up roll. A magnetic roller, positioned after developer roll 38 in the direction of arrow 12, is a carrier granular removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pretransfer light from a lamp (not shown) to reduce the attraction between photoconductive belt and the toner powder image. Next, a corona generating device 40 charges the copy sheet to the proper magnitude and polarity so that the copy sheet is tacked to photoconductive belt 10 and the toner powder image attracted from photoconductive belt 10 to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally be the reference numeral 46, which permanently affixes the transferred toner powder image to the copy sheet. Preferably, fuser assembly 46 includes a heated fuser roll 48 and pressure roll 50 with the powder image on the copy sheet contacting fuser roll 48. The pressure roll is cammed against the fuser roll to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfer to a donor roll and then to the fuser roll.

After fusing, the copy sheet are fed through a decurler 52. Decurler 52 bends the copy sheets in one direction to a put a known curl in the copy sheet and then bends it in the opposite direction to remove the material.

Forwarding rollers 54 then advance the sheet to duplex turn roll 56. Duplex selenoid gate 58 guides the sheet to the finishing station or to duplex tray 60. At finishing station F, copy sheets are stacked in a compiler tray and attached to one another to form set. The sheets are attached to one another either by a binding device or stapling device. In either case, a plurality of documents are formed in finishing station F. One duplex selenoid gate 58 diverts the sheet into duplex tray 60, duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are being reproduced.

In order to complete duplex copying, the simplex sheets in tray 60 are fed, in seriatim, by bottom feeder 62 from tray 60 back to transfer station D via conveyor 64 and roller 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 66. Secondary tray 66 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to roll 66 and then to transfer station D.

Copy sheets may also be fed to transfer station D from auxiliary tray 72. The auxiliary tray 72 includes an elevator driven by a bidirectional motor. Its controller has the ability to drive the tray up or down. When the tray is in the down position, stacks of copy sheets are loaded thereon or unloaded therefrom. In the up position, successive copy sheets are fed therefrom by sheet feeder 74. Sheet feeder 74 is a friction retard feeder utilizing a feed belt and take-away rolls to advance successive copy sheets to transport 64 which advances the sheets to roll 66 and then to transfer station D.

Secondary tray 68 and auxiliary tray 72 are secondary sources of copy sheets. A high capacity feeder, indicated generally by the reference numeral 76 is the primary source of copy sheets. High capacity feeder 76 includes a tray 78 supported on a elevator 80. The elevator is driven by a bidirectional AC motor to move the tray up or down. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to a take-away drive roll 82 and idler rollers 84. The drive roll and idler rollers guide the sheet onto transport 86. Transport 86 advances the sheet to roll 66 which, in turn, move the sheet to transfer station D.

Figure 1:
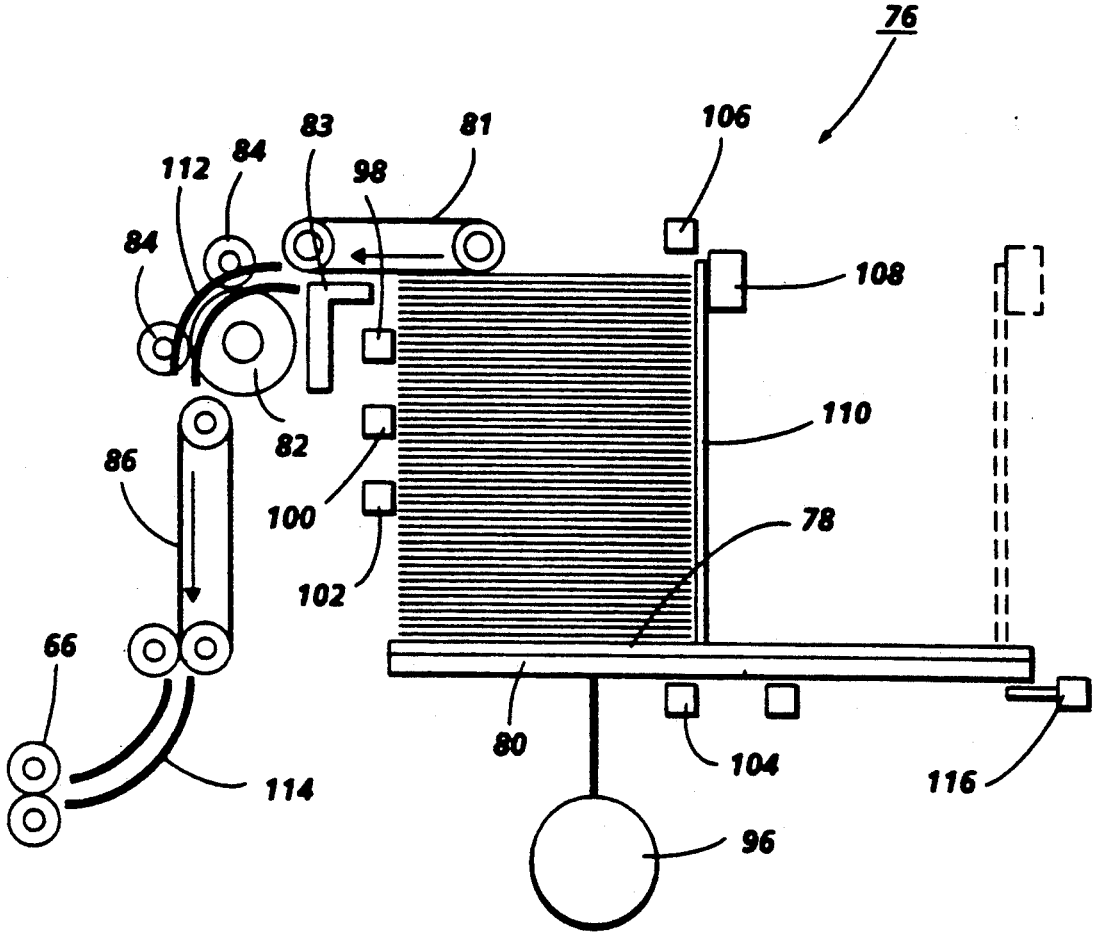
FIG. 1 is a schematic elevational view showing the sheet handling apparatus used in the FIG. 3 printing machine.

Secondary tray 68, auxiliary tray 72, and high capacity feeder 76 all have associated therewith a stack height sensor. The stack height sensor determines when the stack sheets are positioned closely adjacent to the sheet feeder. Thus, the stack height sensor controls the movement of the tray in a vertical direction relative to the sheet feeder. As successive sheets are advanced from the stack disposed on the respective tray, the stack height sensor detects the absence of sheets adjacent the sheet feeder and regulates a motor for advancing the tray upwardly to position the next successive topmost sheet of the stack adjacent the sheet feeder. In this way, successive topmost sheets are advanced from the respective stack of sheets by the corresponding sheet feeder. The stack height sensor of the present invention will be shown only with reference to high capacity feeder 76. However, one skilled in the art will appreciate that the stack height sensor may be used under any circumstance in which if necessary to determine the absence or presence of a sheet at a selected location. However High capacity feeder 76 will be described hereinafter with reference to FIG. 1 and the stack height sensor of the present invention with respect to FIG. 2.

With continued reference to FIG. 3, after the copy sheet is separated from the photoconductive belt, residual toner particles invariably remain thereon. After transfer, photoconductive belt 10 passes beneath corona generating device 94 which charges the residual toner particles to the proper polarity. Thereafter, a precharge erase lamp (not shown) located inside photoconductive belt 10 discharges the photoconductive belt in preparation for the next successive imaging cycle. Residual particles are removed from the photoconductive surface at cleaning station G. Cleaning station G includes an electrically biased cleaner brush 88 and detoning rolls 90 and 92, i.e. waste and reclaim detoning rolls. The reclaim roll is electrically biased negatively relative to the cleaner roll so as to remove toner particles therefrom. The waste roll is electrically biased positively relative to the reclaim rolls so as to remove paper, debris and wrong sign toner particles. The toner particles on the reclaim roll are scraped off and deposited in a reclaim auger (not shown), where it is transported out of the rear of cleaning station G.

Figure 2:
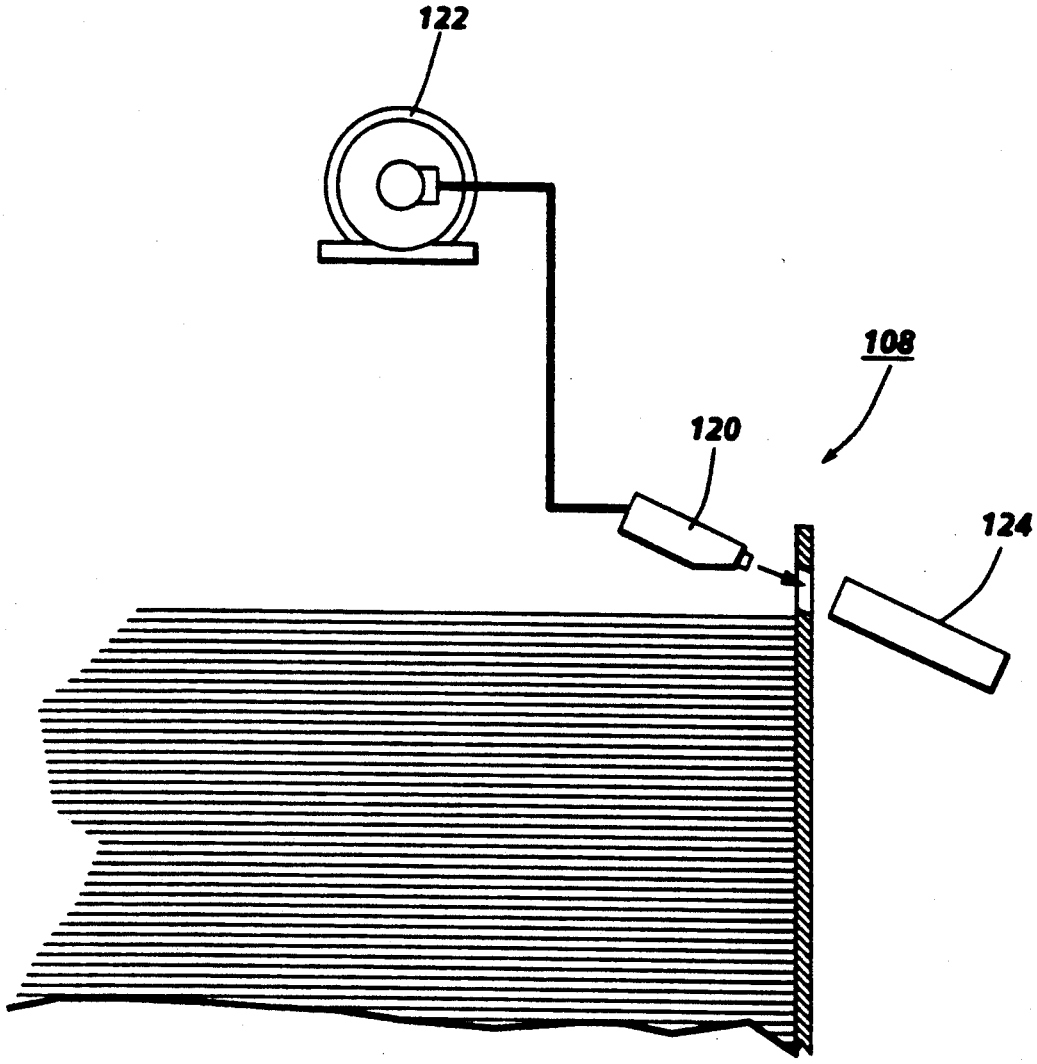
FIG. 2 illustrates the pneumatic detector used in the FIG. 1 sheet handling apparatus.

Referring now to FIG. 2, the details of high capacity feeder 76 will be described hereinafter. High capacity feeder 76 includes a tray 78 supported on an elevator 80. Elevator 80 is driven by a bi-directional AC motor 96. Motor 96 drives elevator 80 to move tray 78 up and down. Tray position sensors 98 and 100 are used to maintain the loading level while the tray is being loaded. Up limit switch 106 and down limit switch 104 deenergize motor 96 to prevent the elevator from moving the tray to far in the vertical direction. Stack height detector 108 is mounted on movable rear guide 110 and provides an indication of when the uppermost sheet of the stack is in the feeding position. Stack height detector 108 controls motor 96 to maintain the uppermost sheet of the stack in the sheet feeding position adjacent feed belt 81. Air knife and fluffer 83 direct air onto the stack of sheets in the sheet feeding position. There are two fluffers blowing against the lead edge of the stack of sheets and one fluffer blowing against the rear edge of the stack of sheets. As the top sheet is separated from the remaining sheets in the stack, a vacuum pulls the top sheet against feed belt 81. The air knife is then used to separate the next copy sheet from the remainder of the sheets in the stack as the prior top sheet is advanced by feed belt 81 into baffle 112. Take-away drive roller 82 cooperates with idler rollers 84 to move the sheet onto vertical transport 86. Transport 86 moves the sheet into baffle 114 which guides the sheet into the nip defined by roller pair 66. As shown in FIG. 3, roller pair 66 move the sheet to transfer station D. The high capacity feeder tray 78 is lowered to the operator access level in the event of sheet jams, low paper signals or operator down commands. Tray 78 is positioned so that the topmost sheet of the stack is in the sheet feed position. If a low paper signal is transmitted to the controller, motor 96 is energized to move elevator 80 and tray 78 in a downward direction until sensor 98 indicates the absence of sheets. When sheets are loaded on tray 78, sensor 98 and sensor 100 indicate the presence of sheets thereon and motor 96 is energized to move elevator 80 and tray 78 in an upward direction until sensor 108 indicates that the topmost sheet of the stack is properly positioned adjacent the sheet feeder. Stack height detector 108 is a pneumatic sensor. Further details of the operation of stack height sensor 108 will be described hereinafter with reference to FIG. 2.

Referring now to FIG. 2, pneumatic sensor 108 includes a nozzle 120 positioned to direct an air jet at the uppermost sheets of the stack diagonal to the edge. Pump 122 is coupled to nozzle 120 to provide a source of pressurized air thereto. The air jet is timed so as to be on only during the gap or time between feeding successive topmost sheets from the stack. A pressure sensor 124 is positioned to have the jet of air impinge thereon. One suitable type of pressure sensor or transducer is a piezoelectric crystal. When the pressurized air impacts on the pressure transducer, the pressure transducer transmits an electrical signal indicting the absence of a sheet at the prescribed location, i.e. the location wherein the jet of air is passing. Conversely, when the jet of air is blocked, no jet of air impacts the pressure transducer and the pressure transducer does not transmit a signal at this time. When no signal is transmitted from pressure transducer 124, the controller or control logic indicates that the jet of air is blocked by the stack of sheets. Thus, the stack of sheets are positioned in the proper or prescribed location with the topmost sheet adjacent the sheet feeder. The pneumatic stack height detector of the present invention employs a nozzle coupled to a pump which generates pressurized air. The pressurized air is transmitted via the nozzle as a jet of air which impacts on a pressure transducer. When the air jet impacts on the pressure transducer, the pressure transducer transmits an electrical signal indicative thereof. When the stack of sheets blocks the air jet, the pressure transducer does not transmit an electrical signal and, at this time, the controller indicates that the stack of sheets are at the preselected location. When the pressure transducer transmits an electrical signal, i.e. the air jet is unblocked, the controller regulates the motor to move the elevator on which the tray having the stack of sheets is disposed, in an upwardly direction to position the topmost sheet adjacent the sheet feeder and to block the air jet. In this way, the location of the topmost sheet of the stack of sheets may regulated by a signal corresponding to the blocking and unblocking of the air jet.

In recapitulation the pneumatic stack height sensor utilizes a nozzle which directs a jet of air onto a pressure transducer. When the jet of air is blocked by the uppermost sheets of the stack, the pressure transducer is inhibited and does not transmit a signal. Alternatively, when the jet of air impacts on the pressure transducer, the pressure transducer is enabled and does transmits a signal therefrom. When the pressure transducer transmits a signal, the signal indicates that the topmost sheet of the stack is spaced from the sheet feeder. Alternatively, when the pressure transducer does not transmit a signal, i.e. the jet of air is blocked, the pressure transducer indicates that the topmost sheet of the stack is properly located at the preselected location for sheet feeding.

It is, therefore, evident that there has been provided, in accordance with the present invention, a pneumatic stack height detector that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications, and variations as fall within the spirit and broad scope of the appended claims.

I claim:

1. An electrophotographic printing machine of the type in which a latent image is developed on a photoconductive member and the developed image is transferred to a copy sheet with successive copy sheets being supplied from a stack thereof, wherein the improvement includes:

a sheet feeder;

a tray arranged to have a stack of copy sheets disposed thereon, said tray being adapted to move between a first position with an outermost copy sheet of a stack being adjacent the sheet feeder and a second position remote therefrom, said sheet feeder being adapted to advance successive outermost copy sheets from the stack thereof with said tray being in the first position;

means for moving the tray to control the position thereof;

means for generating a flow of air; and means for receiving the flow of air from said generating means, said receiving means being enabled to transmit a signal indicative of the absence of the stack of copy sheet at the first position in response to receiving the flow of air and being inhibited from transmitting the signal in response to the stack of copy sheets blocking the flow of air to indicate the presence of the outermost copy sheet of the stack of sheets being at the first position adjacent said sheet feeder, said moving means, in response to the signal from said receiving means, moving said tray to position the outermost copy sheet of the stack at the first position adjacent said sheet feeder.

2. A printing machine according to claim 1, wherein said generating means includes:

a nozzle; and an air pump coupled to said nozzle, to produce a flow of air to said nozzle.

3. A printing machine according to claim 2, wherein said receiving means includes a pressure transducer adapted to transmit an electrical signal in response to a flow of air impacting thereon.

4. A printing machine according to claim 3, wherein pressure transducer includes a piezoelectric transducer.

* * * * *